US007665638B2

(12) United States Patent
Garcia-Ruiz et al.

(10) Patent No.: US 7,665,638 B2
(45) Date of Patent: Feb. 23, 2010

(54) PACKAGED LIQUID LAUNDRY COMPOSITIONS

(75) Inventors: Humberto Garcia-Ruiz, Shelton, CT (US); Richard Paul McNabb, Milford, CT (US)

(73) Assignee: The Sun Products Corporation, Wilton, CT (US)

( * ) Notice: Subject to any disclaimer, the term of this patent is extended or adjusted under 35 U.S.C. 154(b) by 281 days.

(21) Appl. No.: 11/260,903

(22) Filed: Oct. 28, 2005

(65) Prior Publication Data

US 2007/0095779 A1 May 3, 2007

(51) Int. Cl.
*B65D 23/00* (2006.01)

(52) U.S. Cl. ..... 222/566; 222/108; 40/310; 215/12.2; 428/35.1

(58) Field of Classification Search ..... 222/108, 222/109, 111, 566, 571, 572; 215/12.2, 382–384; 410/310; 428/34.9, 35.1; 156/84–86; 264/342 R; 40/310

See application file for complete search history.

(56) References Cited

U.S. PATENT DOCUMENTS

| | | | | |
|---|---|---|---|---|
| D199,460 | S | 10/1964 | Utely | |
| D238,753 | S | 2/1976 | McKinney | |
| 4,013,496 | A | 3/1977 | Amberg | |
| 4,016,706 | A | 4/1977 | Braker et al. | |
| D253,630 | S | 12/1979 | McCredie | |
| 4,248,030 | A | 2/1981 | Heckman | |
| 4,447,280 | A | 5/1984 | Malthouse | |
| 4,600,128 | A * | 7/1986 | Rohrer | 222/108 |
| 4,608,284 | A | 8/1986 | Roales | |
| 4,626,455 | A | 12/1986 | Karabedian | |
| D308,022 | S | 5/1990 | Mintz et al. | |
| 4,977,002 | A | 12/1990 | Hoffman | |
| 4,983,238 | A | 1/1991 | Yoshida et al. | |
| D323,110 | S | 1/1992 | Simms et al. | |
| D325,525 | S | 4/1992 | Aliano et al. | |
| 5,207,356 | A * | 5/1993 | Krall | 222/109 |
| 5,240,529 | A | 8/1993 | Hoffman | |

(Continued)

FOREIGN PATENT DOCUMENTS

| | | |
|---|---|---|
| EP | 1083129 | 3/2001 |

(Continued)

OTHER PUBLICATIONS

Office Action issued for U.S. Appl. No. 11/260,904 on Jan. 9, 2009.

(Continued)

*Primary Examiner*—J. Casimer Jacyna
(74) *Attorney, Agent, or Firm*—Sterne, Kessler, Goldstein & Fox P.L.L.C.

(57) ABSTRACT

A laundry product is provided including a liquid concentrated detergent or fabric softening composition held in a dispensing bottle of a type not featuring a through-apertured gripping handle. The bottle includes a body having an open end terminating in a circular neck, first and second plane traversing a length of the bottle body with each bisecting the neck, the first and second planes being orthogonally oriented to one another, the first plane dividing front and rear major faces of the body into asymmetric first and second areas. A shrink sleeve is fitted over the body from a base of the neck down toward the closed end. A removable cap is fittable over the neck.

13 Claims, 4 Drawing Sheets

U.S. PATENT DOCUMENTS

| | | | | |
|---|---|---|---|---|
| D347,791 | S | 6/1994 | Lathrop et al. | |
| 5,524,778 | A | 6/1996 | De Caluwe et al. | |
| D373,535 | S | 9/1996 | Lathrop et al. | |
| D381,911 | S | 8/1997 | Lathrop et al. | |
| 5,711,061 | A | 1/1998 | Blake et al. | |
| 5,725,309 | A | 3/1998 | Robinson | |
| 5,843,362 | A | 12/1998 | Yoshii et al. | |
| 5,897,722 | A | 4/1999 | Bright | |
| 6,245,181 | B1 | 6/2001 | Bright | |
| 6,270,866 | B1 | 8/2001 | Okuda et al. | |
| 6,296,129 | B1 | 10/2001 | Kawasaki | |
| D467,506 | S | 12/2002 | Jones et al. | |
| D469,017 | S | 1/2003 | Mauro | |
| D470,055 | S | 2/2003 | Blair et al. | |
| D470,416 | S | 2/2003 | Blair et al. | D9/523 |
| 6,610,640 | B1 * | 8/2003 | Zappone et al. | 510/296 |
| D485,185 | S | 1/2004 | Versace | |
| D486,066 | S | 2/2004 | Hannen et al. | |
| 6,800,599 | B2 * | 10/2004 | Manske | 510/228 |
| D504,620 | S | 5/2005 | Kazuo et al. | |
| D518,731 | S | 4/2006 | Yourist et al. | |
| D525,137 | S | 7/2006 | Helps | |
| D542,140 | S | 5/2007 | Garcia-Ruiz | |
| D543,861 | S | 6/2007 | Garcia-Ruiz | |
| 2001/0051238 | A1 | 12/2001 | Ito et al. | |
| 2002/0124931 | A1 | 9/2002 | Etesse | |
| 2002/0153345 | A1 | 10/2002 | Johnson et al. | |
| 2004/0129369 | A1 | 7/2004 | Johnson et al. | |
| 2004/0258938 | A1 | 12/2004 | Yamanaka et al. | |
| 2005/0139568 | A1 | 6/2005 | Falk | |
| 2005/0274687 | A1 | 12/2005 | McCutchan | 215/12.2 |
| 2006/0141182 | A1 * | 6/2006 | Giblin | 428/34.9 |
| 2007/0095784 | A1 | 5/2007 | McNabb et al. | |

FOREIGN PATENT DOCUMENTS

| | | |
|---|---|---|
| EP | 1176100 | 1/2002 |
| GB | 2098952 | 12/2001 |

OTHER PUBLICATIONS

Notice of Allowance for U.S. Appl. No. 29/234,042 on Dec. 13, 2006.
Notice of Allowance for U.S. Appl. No. 29/234,041 on Dec. 13, 2006.
Office Action issued for U.S. Appl. No. 10/750,296 on Aug. 26, 2005.
Office Action issued for U.S. Appl. No. 11/260,904 on Dec. 28, 2007.
Office Action issued for U.S. Appl. No. 11/260,904 on May 12, 2008.
Office Action issued for U.S. Appl. No. 11/260,904 on Jul. 29, 2008.
Office Action mailed on May 27, 2009, U.S. Appl. No. 11/260,904, McNabb, R. P., et al., filed Oct. 28, 2005.

* cited by examiner

PACKAGED LIQUID LAUNDRY COMPOSITIONS

BACKGROUND OF THE INVENTION

1. Field of the Invention

The invention concerns a laundry product which is a liquid concentrated detergent or fabric conditioner composition packaged within a bottle particularly suitable for dispensing the composition.

2. The Related Art

Ordinarily liquid laundry detergent products are packaged in jugs. This packaging features an aperture defining a handle area. A consumer inserts several fingers into the aperture to grip and manipulate the jug. Illustrative is US patent application 2005/0139568 (Unilever) disclosing a jug with a shrink-sleeve covering extending over a full outer surface, except for the handle area. A spout is fitted within a dispensing opening and coverable by an overcap.

A significant amount of liquid product must be dispensed for each load of laundry. Relatively large size jugs are needed to accommodate some reasonable number of washes per package of product. The large sizes require apertured handles for lifting and manipulation.

A new generation of concentrated liquid laundry products are now entering the marketplace. The same number of laundry loads can be washed with a much smaller volume of liquid. The often unwieldy jugs can now be downsized to smaller bottles. Apertured handles are no longer necessary nor readily engineered into the smaller sizes.

Liquid laundry products packaged in bottles traditionally are marked with adhesively applied local area labels. Information located on these labels include trademarks, advertising, ingredients, weights, UPC symbols, wash instructions among other writings.

A problem arises with concentrated liquids. Therein the actives such as surfactants are present at much higher levels than with non-concentrates. There can be a tendency to smear inks on the label obliterating important information relating to use and safety. Also there may be a tendency for greater residue deposition on outside bottle walls. This arises from the concentrate often being thicker and less flowable. With less water normally present, evaporation is quicker leading to deposition of sticky material on the bottle wall surfaces.

A better approach is needed in the packaging of concentrated liquid laundry or fabric conditioning compositions. Ink integrity needs to be protected and for greater aesthetic appeal errant waste liquid composition must experience greater sheeting from the bottle wall surfaces.

SUMMARY OF THE INVENTION

A laundry product is provided which includes:

(i) a liquid concentrated detergent or fabric softening composition comprising by weight from about 20 to about 80% total surfactant or from about 10 to about 40% total fabric softening agent;

(ii) a dispensing bottle without a through-apertured gripping handle for containing the concentrated composition, the bottle comprising a bottle body with a closed end and an open end, the open end terminating in a circular neck, first and second planes traversing a length of the bottle body with each bisecting the neck, the first and second planes being orthogonally oriented to one another, the first plane dividing front and rear major faces of the body each into asymmetric first and second areas;

(iii) a shrink-sleeve fitted over the body from a base of the neck down toward the closed end; and (iv) a removable cap fittable over the neck.

BRIEF DESCRIPTION OF THE DRAWING

Further advantages and features of the present invention will become more readily understood through the following drawing in which.

DETAILED DESCRIPTION OF THE INVENTION

Now it has been found that surrounding the body of the bottle with a shrink-sleeve avoids destruction of inked information. The shrink-sleeve is a multi-layered web with inked information being protected by at least one outer transparent layer of film in the multi-layered shrink-sleeve.

In contrast to the molded plastic bottle wall surfaces, shrink sleeves have less friction. Liquids can more quickly be sheeted away. This minimizes accumulation of sticky residues from the liquid compositions on outer surfaces of the bottle.

Further, the bottle body is asymmetrically arranged to provide gripping cues to help a user pour liquid. Unfortunately, the asymmetric arrangement presents challenges for smoothly accepting the shrink-sleeve. This problem is overcome by a ledge and terraces increasing volume near the top of the bottle to balance broader areas near the bottom.

By the present construction, a consumer can be assured of a correct grip on the over-capped bottle. Through the cue of an angled ledge and an asymmetric body, grip becomes intuitive. Removal of the cap with the non-gripping hand now exposes a spout properly oriented with a leading edge allowing pouring in a natural manner away from the user's body. Also the spout is oriented along a less protruding sidewall panel of the bottle body. Soilage of the body by errant drops is thereby minimized.

Figure 1:
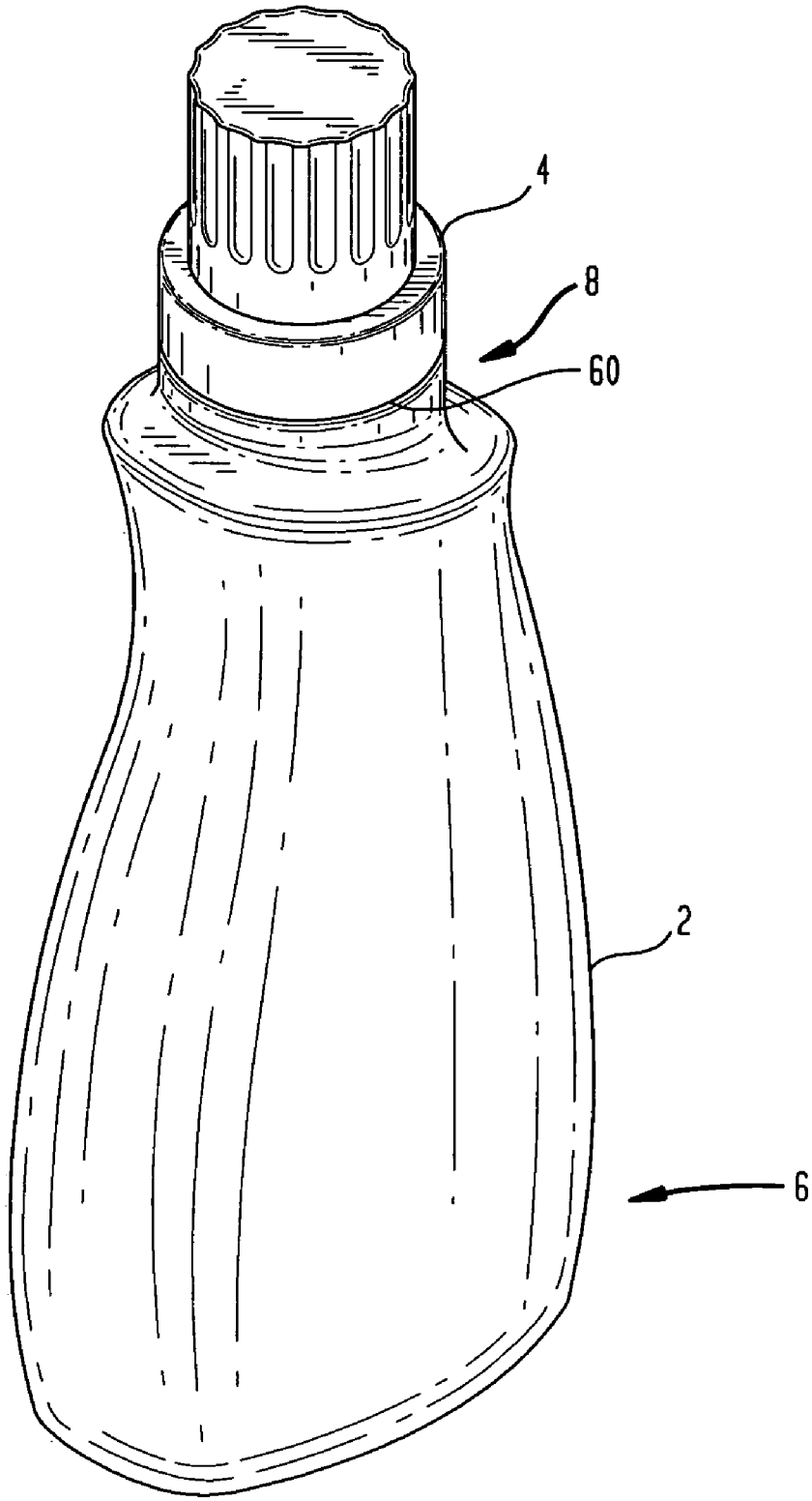
FIG. 1 is a perspective view of a bottle with cap according to the present invention.

FIG. 1 illustrates a first embodiment of the present invention. Therein is shown a bottle body 2 covered with a cap 4. The body features a closed end 6 and an open end 8.

Plastics suitable for the manufacture of bottle bodies according to the present invention include but are not limited to high-density polyethylene, low-density polyethylene, metallocene catalyzed polyolefin, polypropylene, polyethylene terephthalate and combinations thereof. Bottle body walls may be formed of single or multiple layers. Particularly useful are multi-layer laminates which incorporate substantial amounts of recycled plastic resin in addition to virgin resin. Normally the bottle body is formed through an extrusion or molding process. Caps and spout fitments may be extruded or molded from any of the aforementioned plastics suitable for the body.

Figure 2:
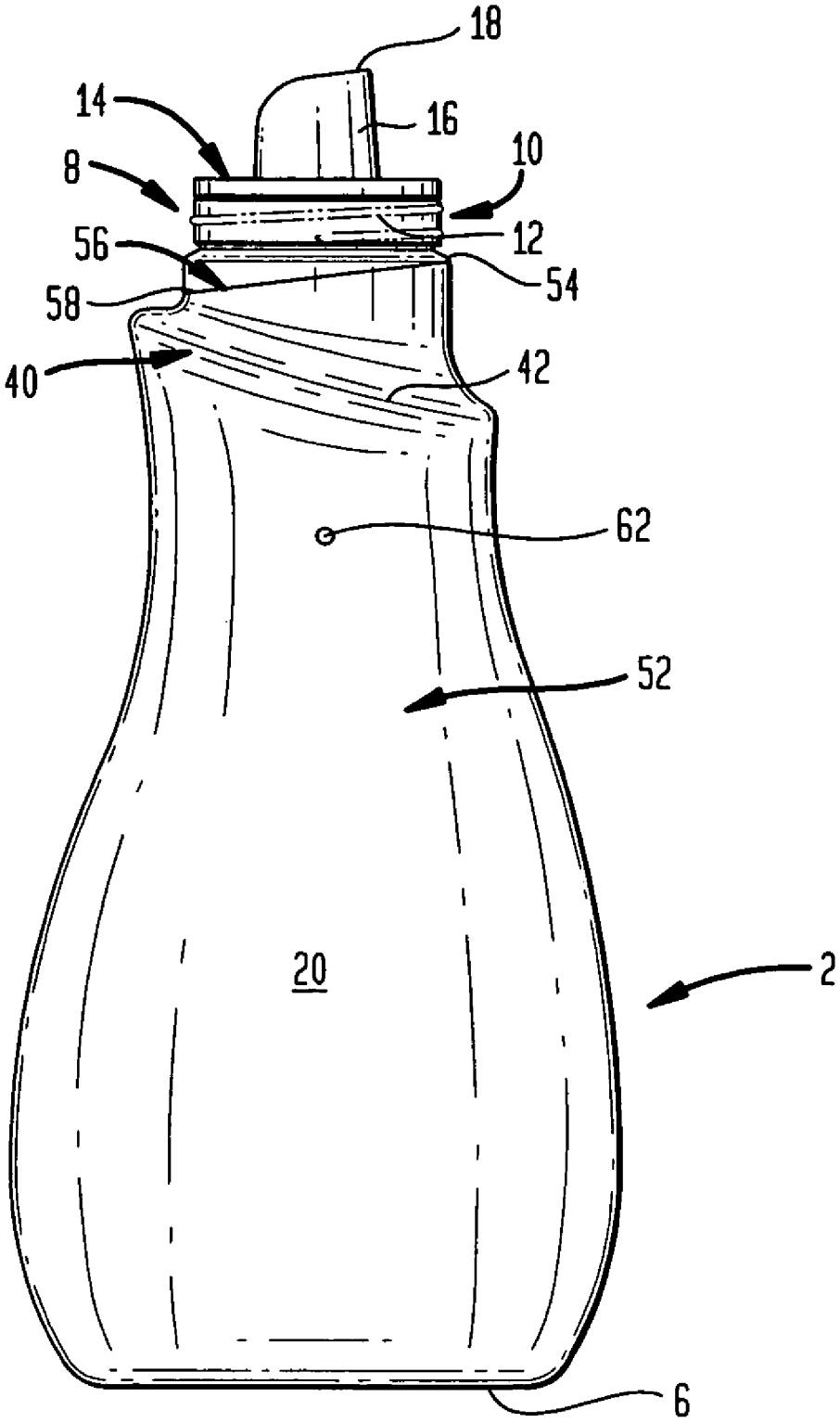
FIG. 2 is a rear view of the bottle shown in FIG. 1 with cap removed.

FIG. 2 illustrates the dispensing bottle with cap removed. Revealed is a neck 10 near the open end of the body. Thread tracks 12 are formed into and circumscribe the neck. A complementary set of tracks are fashioned on an inner wall at an open end of the cap 4. The thread tracks 12 allow the cap to sealingly engage the neck to prevent spillage of liquid laundry product.

Advantageously for one embodiment of the present invention, a spout fitment 14 is secured within the neck. Therein rising upwardly is a pour spout 16. Along an uppermost perimeter of the pour spout is a leading edge 18. Optimum pouring in one direction without errant drippage is achieved by dispensing the liquid through the spout over the leading edge 18.

The body features two major faces. The first is a rear major face 20 seen in FIG. 2. The second is a front major face 22 shown in FIG. 3. A first plane A traverses a length of the bottle body bisecting the pour spout. Plane A divides the body into asymmetric first area 24 and second area 26.

Figure 3:
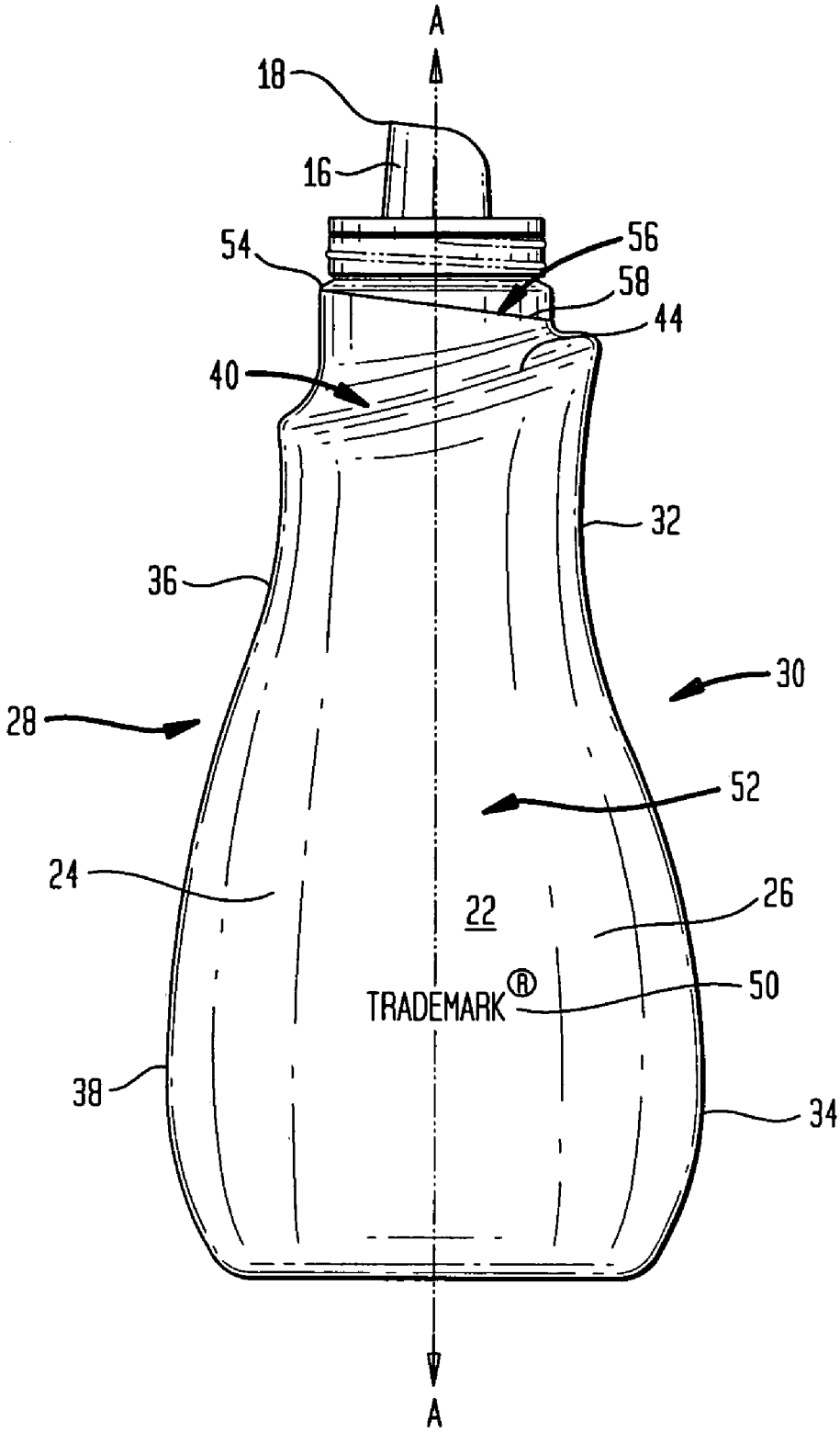
FIG. 3 is a front view of the bottle shown in FIG. 1 with cap removed.

FIG. 3 further illustrates a left sidewall 28 and a right sidewall 30. The left sidewall 28 features a less curved straighter profile than the right sidewall 30. The right sidewall has a more pronounced concave curved section 32 near the open end and more pronounced outwardly convex curved section 34 near the closed end than respective concave and convex curved sections 36 and 38 on the left sidewall.

Figure 5:
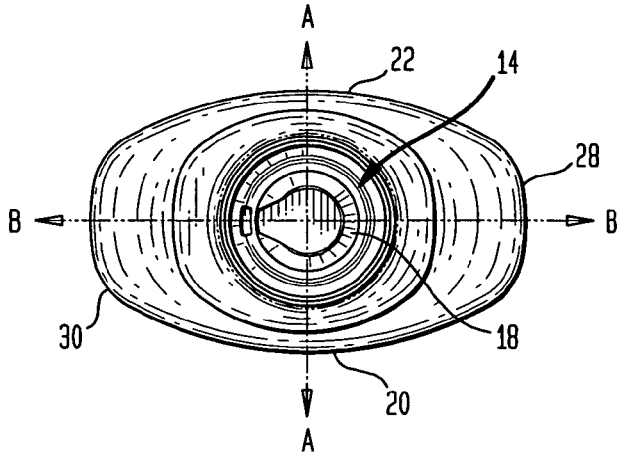
FIG. 5 is a top view of the bottle shown in FIG. 2.

FIG. 5 illustrates a second plane B orthogonally oriented relative to plane A. Plane B divides the bottle body into a pair of symmetrical areas.

Figure 4:
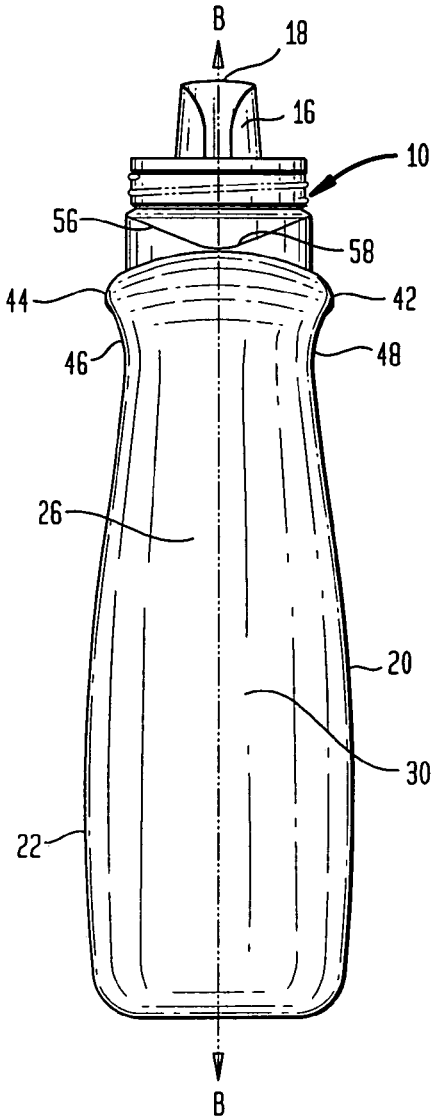
FIG. 4 is a right-side elevational view focusing on the right sidewall of the bottle shown in FIG. 3.

FIGS. 2 and 3 further show a gripping ledge 40 adjacent to the open end 8. Gripping ledge 40 is positioned beneath neck 10 and angled diagonally downward beginning in the second area 26 and terminating in the first area 24. FIG. 4 best illustrates terraces 42 and 44 outwardly protruding as members of the ledge on respective rear and front major faces 20, 22. Beneath each of the terraces are concave surfaces 46, 48. In combination the terraces and concave surfaces allow a user's hand to securely grip the bottle body. For a right-handed grip, the thumb cradles within the concave surface 46 while the other fingers curl into the concave surface 48. Terraces 42 and 44 prevent downward slippage from the grasp of the user.

Ordinarily a trademark 50 identifying the laundry product is placed on one or both of the major front and rear faces. As an additional cue for properly gripping the bottle, the front major face 22 is shown to solely receive the trademark. If required to also be present on the rear major face 20, the trademark on the front major face 22 will be of a larger size.

Other information besides the trademark may be required by law or are advantageously placed on labeling for the laundry product. Traditionally this information has been printed on an adhesive label and includes ingredients, advertising, manufacturer identity, UPC symbol, weight and instructions for use. Inks used on these labels have in the past not been protected from a severe attack of chemical solvents. In traditional laundry products this has not been a particular problem. For concentrated products inked labels become more vulnerable. The present invention protects the printed information through shrink-wrap technology.

FIG. 2 illustrates a shrink sleeve 52 form-fittingly pressed over the bottle body 2 covering all surfaces from the closed end 6 to a first landing 54 on neck 10. An upper leading edge 56 of the shrink sleeve 52 engages landing 54 adjacent first area 24 of the bottle body. A rear section 58 of the leading edge 56 falls short of landing 54 adjacent the second area 26 of the bottle body. The asymmetry of leading edge 56 arises from the symmetric nature of the shrink sleeve fitted to the body and the asymmetric perturbations of the ledge and bottle curvatures. These size perturbations ensure that the leading edge 56 has fullest coverage on the pouring direction side, i.e. the first area 24 adjacent the left sidewall 28. Cap 4 when fully closeably threaded will along its open circumference 60 be positioned to directly adjoin landing 54 and leading edge 56 of the shrink-sleeve.

An aperture 62 fully piercing the shrink sleeve 52 is positioned on an area below one of the ledges 42 or 44. This aperture 62 relieves stretching stress caused by the ledge that ordinarily would result in wrinkling and print distortion along the shrink sleeve.

Shrink sleeves are typically made from seamed or seamless tubes. When high quality graphics are desired, shrink film is normally pre-printed to allow full front, back and side graphics. After printing, a welded or solvent-sealed seam provides a longitudinal seam, forming the sleeve.

For purposes of this disclosure, a shrink sleeve is defined as a generally tubular structure defining a longitudinal direction along the axis of the tube and a transverse direction perpendicular to the longitudinal direction. The transverse direction defines a width direction of the lay-flat sleeve and any direction perpendicular to the longitudinal direction of an opened sleeve. The shrink sleeves are made of a heat shrinkable film and have an open top and an open bottom.

In some embodiments of the invention, the sleeves are made of orientated film. The film may be polyvinyl chloride (PVC), polyethylene (PE), polypropylene (PP), other polyolefins and copolymers, polyesters (PETG, OPETE) and polystyrene (OPS). In the preferred embodiments, the major shrink axis is transverse to the longitudinal axis of the sleeve.

The shrink sleeve of this invention may be formed by lamination of first and second layers. The lamination has a determinable longitudinal direction. The first layer is of a material which is both dimensionally stable at room temperature and shrinkable at temperatures substantially elevated above room temperature. The first layer is of a material which is resistant to elongation at least in the longitudinal direction. The first layer is moreover an ink receptive layer having an ink receptive surface adjacent the second layer. Printing is located on a surface between the layers. The material of the second layer is transparent and free of optical distortion whereby to permit clear perception of the printing. The material of the second layer is glossy and slippery to enable the second layer to function as a lubricated layer during application. Still further, the material of the second layer is moisture resistant, resistant to dimensional change at elevated temperatures and scuff resistant.

Materials of the first and second layers can be respectively bi-axially oriented and non-oriented. In accordance with a preferred embodiment of the invention, the first layer is of biaxially oriented polystyrene having a thickness of 0.0005-0.003 inches. The second layer is preferably of non-oriented polypropylene having a thickness of 0.00025-0.002 inches. Preferably these layers have a thickness in the order of magnitude of about 0.001 inches.

Conventional processes for applying the shrink sleeve generally involve placing the sleeve over the bottle, and heating the sleeve to shrink it onto the bottle. Typical wrapping processes are disclosed in U.S. Pat. Nos. 4,013,496; 4,016,706; 4,983,238 and 5,240,529.

Liquid laundry products of the present invention when in concentrated detergent form will contain surfactants as the major active component. Total amount of surfactant may range from about 20 to about 80%, preferably from about 30 to about 70%, more preferably from about 35 to about 55% by weight of the composition. Surfactants may be selected from anionic, nonionic, cationic and amphoteric types. In most instances the detergent will be a combination of anionic and nonionic surfactants.

Nonionic surfactants can be broadly defined as surface active compounds which do not contain ionic functional groups. An important group of chemicals within this class are those produced by the condensation of alkylene oxide groups (hydrophilic in nature) with an organic hydrophobic compound; the latter is aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements. Illustrative but not limiting examples of the various chemical types of suitable nonionic surfactants include:

(a) a polyoxyethylene or polyoxypropylene condensates of aliphatic carboxylic acids, whether linear- or branched-chain and unsaturated or saturated, containing from about 8 to about 18 carbon atoms in the aliphatic chain and incorporating from 5 to about 50 ethylene oxide or propylene oxide units. Suitable carboxylic acids include "coconut" fatty acids (derived from coconut oil) which contain an average of about 12 carbon atoms, "tallow" fatty acids (derived from tallow-class fats) which contain an average of about 18 carbon atoms, palmitic acid, myristic acid, stearic acid and lauric acid.

(b) polyoxyethylene or polyoxypropylene condensates of aliphatic alcohols, whether linear- or branched-chain and unsaturated or saturated, containing from about 8 to about 24 carbon atoms and incprorating from about 5 to about 50 ethylene oxide or propylene oxide units. Suitable alcohols include the "coconut" fatty alcohol, "tallow" fatty alcohol, lauryl alcohol, myristyl alcohol and oleyl alcohol. Particularly preferred nonionic surfactants are $C_{12}$-$C_{15}$ linear primary alcohol ethoxylates with an average of 7-9 moles ethylene oxide.

(c) Polyoxyethylene or polyoxypropylene condensates of alkyl phenols, whether linear- or branched-chain and unsaturared or saturated, containing from about 6 to about 12 carbon atoms and incorporating from about 5 to about 25 moles of ethylene oxide or propylene oxide.

A wide variety of anionic surfactants may be utilized. Anionic surfactants can be broadly described as surface active compounds with negatively charged functional group (s). An important class within this category are the water-soluble salts, particularly alkali metal salts, of organic sulfur reaction products. In their molecular structure is an alkyl radical containing from about 8 to 22 carbon atoms and a radical selected from the group consisting of sulfonic and sulfuric acid ester radicals.

Particularly suitable anionic surfactants for the instant invention are the higher alkyl mononuclear aromatic sulfonates. They contain from 10 to 16 carbon atoms in the alkyl chain. Alkali metal or ammonium salts of these sulfonates are suitable, although the sodium salts are preferred. Specific examples include: sodium linear tridecyl benzene sulfonate; sodium linear pentadecyl benzene sulfonate; and sodium p-n-dodecyl benzene sulfonate. Another useful anionic surfactant is soap. These materials are $C_{12}$-$C_{20}$ fatty acids such as coconut fatty acids neutralized with alkali metal or ammonium salts.

A variety of functional adjunct materials may be included with the surfactants. Illustrative further additives for the detergent compositions include lather boosters (e.g. alkanolamides), foam suppressants (e.g. fatty acids, phosphates, waxes or silicones), bleaches (e.g. perborates or percarbonates), fluorescent whitening agents, perfumes, enzymes, germicides, colorants, builders, anti-deposition aids and combinations thereof.

Concentrated fabric softening compositions will as a main active material include a fabric softening agent. Amounts may typically range from about 10 to about 40%, preferably from about 15 to about 30%, optimally from about 18 to about 25% in total by weight of the composition. Fabric softeners generally are quatemary ammonium fatty acid substituted materials. Illustrative but not limiting examples include ditallowdimethyl ammonium chloride; di(2-tallowamidoethyl) ethoxylated methylammonium methylsulfate; 1-methyl-1-tallowamidoethyl-2-tallow imidazolinium methylsulfate; and combinations thereof.

The term "comprising" is meant not to be limiting to any subsequently stated elements but rather to encompass non-specified elements of major or minor functional importance. In other words the listed steps, elements or options need not be exhaustive. Whenever the words "including" or "having" are used, these terms are meant to be equivalent to "comprising" as defined above.

Except in the operating and comparative examples, or where otherwise explicitly indicated, all numbers in this description indicating amounts of material ought to be understood as modified by the word "about".

All parts, percentages and proportions referred to herein and in the appended claims are by weight unless otherwise indicated.

What is claimed is:

1. A laundry product comprising:

a liquid concentrated detergent or fabric softening composition comprising by weight from about 20 to about 80% total surfactant or from about 10 to about 40% total fabric softening agent;

a dispensing bottle without a through apertured gripping handle for containing the concentrated composition, the bottle comprising:

a bottle body with a closed end and an open end, the open end terminating in a circular neck, first and second planes traversing a length of the bottle body with each bisecting the neck, the first and second planes being orthogonally oriented to one another, the first plane dividing front and rear major faces of the body into asymmetric first and second areas, and a gripping ledge adjacent the open end beneath the neck and angled diagonally downward from the second area toward the first area;

a shrink sleeve fitted over the body from a base of the neck down toward the closed end, the shrink sleeve having a leading upper edge with a section overlapping a landing on the neck adjacent the first area and a section terminating below the landing adjacent the second area thereby providing fuller sleeve coverage on a pouring direction side of the bottle; and a removable cap fittable over the neck.

2. The product according to claim 1 wherein the leading upper dege of the shrink sleeve is slanted relative to the base and the neck, and extends diagonally downward from the section overlapping the landing on the neck adjacent the first area to the section terminating below the landing adjacent the second area.

3. The product according to claim 1 wherein the gripping ledge comprises on each of the front and rear major faces outwardly projecting terraces.

4. The product according to claim 3 wherein the bottle further comprises a concave surface adjacently beneath each of the terraces.

5. The product according to claim 1 wherein the bottle further comprises a left sidewall flanking the first area and formed with a concave and a convex curved section.

6. The product according to claim 5 wherein the bottle further comprises a right sidewall adjacent the second area formed with a concave and a convex curved section and having curvature more pronounced than respective left sidewall concave and convex curved sections.

7. The product according to claim 1 further comprising a trademark printed on the shrink sleeve identifying the laundry product and placed over the front major face, and wherein the shrink sleeve over the rear major face either has no trademark or the trademark is of smaller size than found over the front major face.

8. The product according to claim 1 wherein the shrink sleeve has an aperture penetrating the sleeve in an area directly below the ledge, the aperture relieving stretching stress caused by the ledge that ordinarily would result in wrinkling and print distortion along the shrink sleeve.

9. The product according to claim 1 wherein the bottle further comprises a pour spout fitted into the neck.

10. The product according to claim 1 wherein the composition comprises by weight from about 35 to about 55% total surfactant.

11. The product according to claim 1 wherein the composition comprises by weight from about 15 to about 30% fabric conditioning agents.

12. A laundry product comprising:

a liquid concentrated detergent or fabric softening composition comprising by weight from about 20 to about 80% total surfactant or from about 10 to about 40% total fabric softening agent;

a dispensing bottle without a through apertured gripping handle for containing the concentrated composition, the bottle comprising a bottle body with a closed end and an open end, the open end terminating in a circular neck, first and second planes traversing a length of the bottle body with each bisecting the neck, the first and second planes being orthogonally oriented to one another, the first plane dividing front and rear major faces of the body into asymmetric first and second areas;

a pour spout fitted into the neck, the spout having a leading edge for directing dispensing of liquid composition in one direction toward the first asymmetric area of the body; and a shrink sleeve fitted over the body from a base of the neck down toward the closed end, the shrink sleeve having a leading upper edge with a section overlapping a landing on the neck and a section terminating below the landing, wherein the overlapping section of the shrink sleeve is positioned within the first asymmetric area directly below the leading edge of the pour spout thereby providing fuller sleeve coverage on a pouring direction side of the bottle.

13. The product according to claim 12 wherein the section of the leading upper edge of the shrink sleeve terminating below the landing is positioned within the second asymmetric area, the leading upper edge of the shrink sleeve being slanted relative to the base and the neck and extending diagonally downward from the section overlapping the landing on the neck to the section terminating below the landing.

* * * * *

UNITED STATES PATENT AND TRADEMARK OFFICE

CERTIFICATE OF CORRECTION

PATENT NO. : 7,665,638 B2
APPLICATION NO. : 11/260903
DATED : February 23, 2010
INVENTOR(S) : Garcia-Ruiz et al.

It is certified that error appears in the above-identified patent and that said Letters Patent is hereby corrected as shown below:

Column 6, line 54, reading "upper dege of the shrink sleeve is slanted relative to the base" should read --upper edge of the shrink sleeve is slanted relative to the base--.

Signed and Sealed this

Fourth Day of May, 2010

David J. Kappos

David J. Kappos
*Director of the United States Patent and Trademark Office*